US005881396A

United States Patent [19]

Rivera

[11] Patent Number: 5,881,396

[45] Date of Patent: Mar. 16, 1999

[54] TOILET CLEANER CONTROLLER DEVICE

[76] Inventor: Moises Ramos Rivera, 12932 Maine Woods Ct., Orlando, Fla. 32824

[21] Appl. No.: 1,237

[22] Filed: Dec. 30, 1997

[51] Int. Cl.[6] ..... E03D 9/00

[52] U.S. Cl. ..... 4/225.1; 4/222

[58] Field of Search ..... 4/225.1, 223, 224, 4/227.1, 222

[56] References Cited

U.S. PATENT DOCUMENTS

| | | | |
|---|---|---|---|
| 685,020 | 10/1901 | Venners . | |
| 2,045,473 | 6/1936 | Keillor . | |
| 3,781,926 | 1/1974 | Levey . | |
| 3,890,657 | 6/1975 | Gray . | |
| 4,635,302 | 1/1987 | Dolan . | |
| 5,027,444 | 7/1991 | Tsals . | |
| 5,040,246 | 8/1991 | Zanino | 4/225.1 |
| 5,397,249 | 3/1995 | Weicorek | 4/225.1 |
| 5,603,126 | 2/1997 | Scoggins | 4/225.1 |

*Primary Examiner*—David J. Walczak

*Attorney, Agent, or Firm*—Julian C. Renfro, Esq

[57] ABSTRACT

A toilet cleaner controller device for use in a toilet having a tank equipped with a fill device functioning after a flush to refill the tank with water to a selected level, with this toilet cleaner controller device having therein a reservoir adapted to receive a cleansing chemical able to be dissolved in water. The reservoir has an inlet connection enabling it to be connected to receive water from the water-supplying pipe of the fill device of the toilet tank during the procedure in which the toilet tank is being refilled after a flush. In this way a concentrated cleansing solution will be maintained in the reservoir. A valve is operably installed in the controller device, connected to receive concentrated solution from the reservoir. The valve has an outlet port, with the valve enabling the flow of concentrated solution from the outlet port to the toilet to be readily controlled. I prefer to use a multiposition valve positionable such that the strength of the cleansing solution can be readily modified, with this valve also enabling the cleansing fluid to be delivered only to the toilet bowl, or simultaneously to both the toilet bowl and the toilet tank.

18 Claims, 7 Drawing Sheets

FIG 4
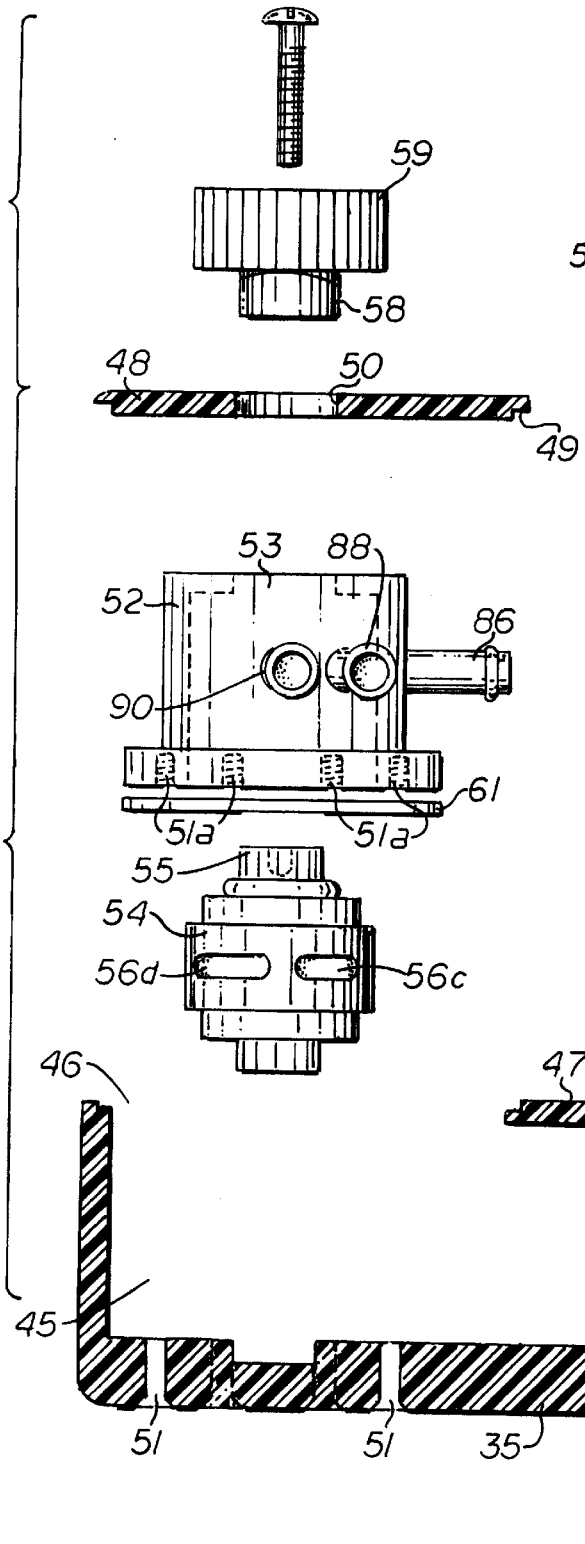
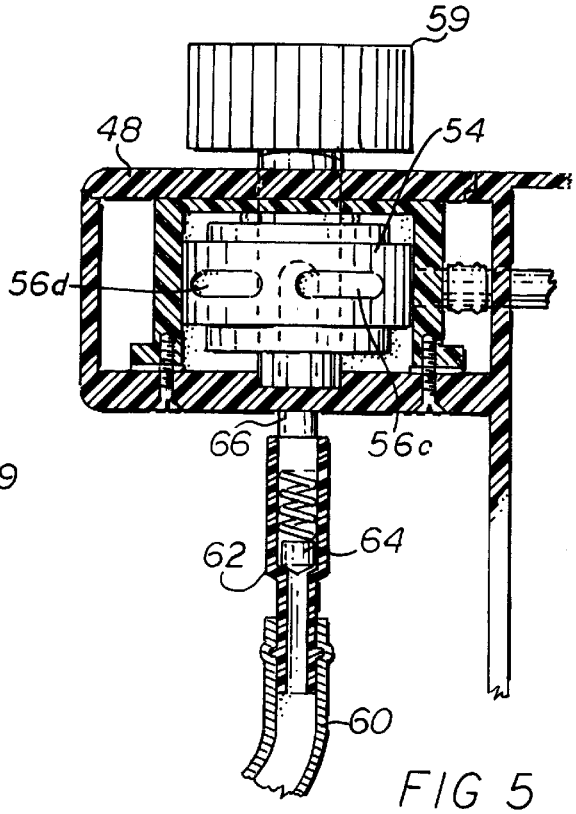
FIG 5

FIG 8
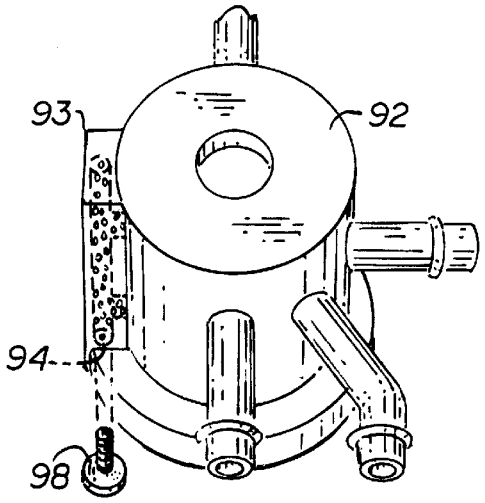
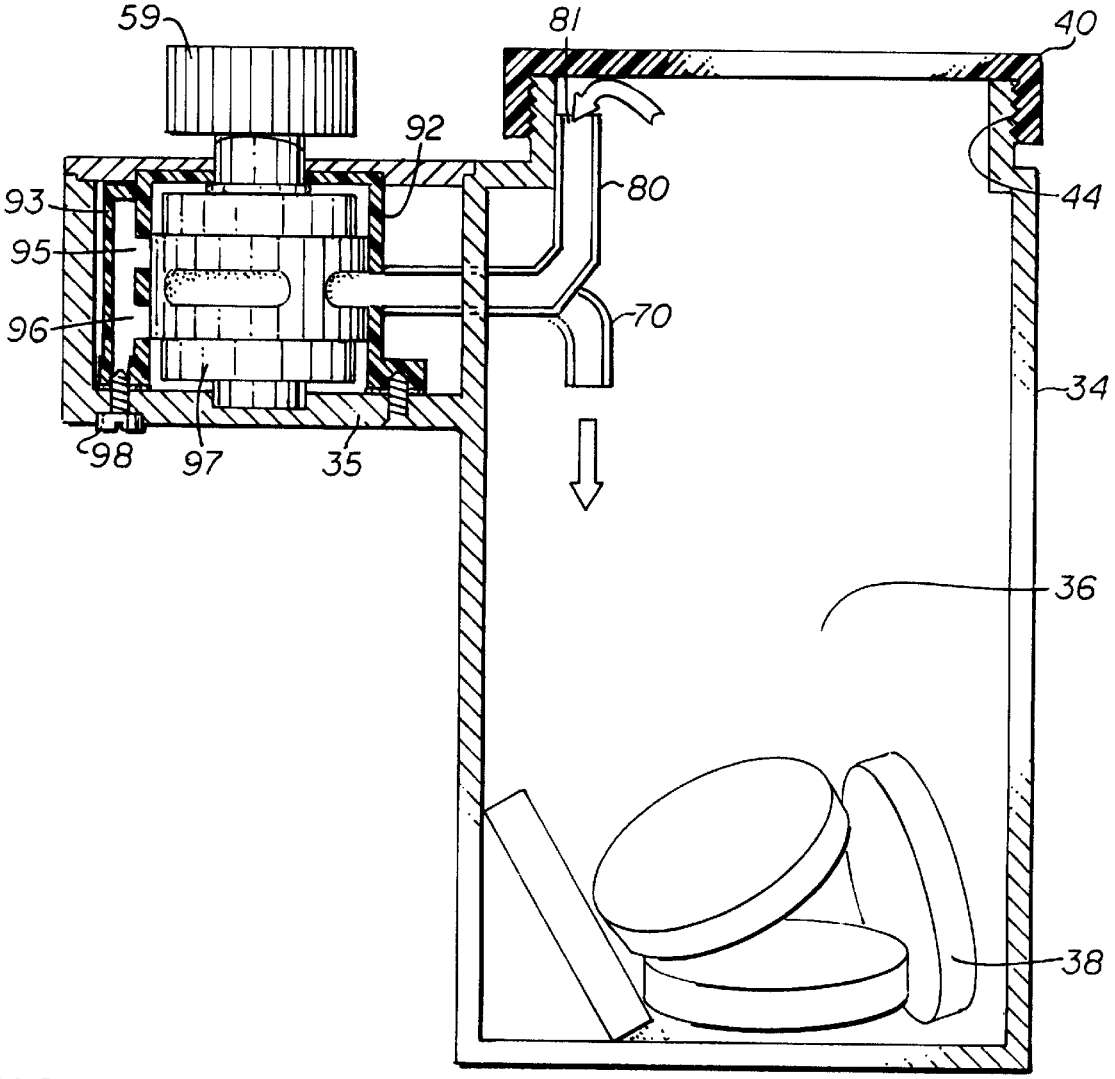
FIG 9

TOILET CLEANER CONTROLLER DEVICE

BACKGROUND OF THE INVENTION

1. Field of the Invention

This invention relates to devices for sanitizing toilet tanks and bowls, and more particularly to a device for selectively controlling the rate of flow and volume of a sanitizing liquid to be discharged into a toilet tank and bowl.

2. Description of the Prior Art

Efforts to effect a sanitization of toilet bowls extend back almost to the time that toilets first became popularly accepted as a part of American life. Thus, in U.S. Pat. No. 685,020 issued to J. H. Venner on Oct. 22, 1901, a boxlike container was provided for a toilet tank, in the bottom of which was placed a disinfectant. Holes were provided both in the side of the container and in the top. As the water in the tank rose, some was admitted into the container to produce a saturated solution of the disinfectant. When the tank was flushed and the water level of the tank dropped below the holes in the side of the container, the solution ran out and into the toilet bowl for sanitization purposes.

This principle of operation has been utilized for numerous devices which have been patented since that of Venner, involving the use of plastic bags or pouches, or compressed tablets inserted into a toilet tank.

One problem with all of these prior art devices has been that they were orificed for only one volume of saturated solution and one rate of flow thereof into the tank and thence to the toilet bowl. This was true despite the fact that there are often considerable variations in conditions of the toilet and its use, which make it desirable for the person who maintains the cleanliness of the toilet to be able to vary the amount of sanitizer which is discharged into the tank and thus reach the bowl. Some cleansing solutions can be used full strength, whereas other cleansing solutions are so strong that they should always be utilized in a diluted condition.

For example, when first used, or if the bowl is subjected to frequent use, it may be desirable to provide for a substantial flow of the sanitizer solution from its container. The amount of concentration, and the amount of flow of the concentrated solution in each instance will of course depend upon the type of sanitizer selected for use. On the other hand, after a toilet has been well sanitized, and particularly where it is not subjected to heavy use, it may be possible to get by with a minimum sanitizer discharge. In addition, since the hardness of water varies in different locations, it may be desirable to vary the discharge of the sanitizer in accordance with the water hardness condition to prolong the life span of the sanitizer cake.

Prior art devices have quite unfortunately, offered no practical control of the solution discharge. Therefore, in order to insure that sufficient solution is provided for all conditions, commercial devices are orificed to provide maximum discharge at all times. This results in more rapid depletion of the chemical sanitizer material than is necessary, which of course is to the user's detriment.

Known prior art devices of non-complex construction have made no provision for limiting the amount of liquid dispensed per flushing operation, and if a flushing mechanism sticks or becomes otherwise inoperative during a flushing operation, the entire contents of a receptacle containing a concentrated solution could be dispensed into the flush tank. The amount of water contained within a flush tank is normally three gallons or more, and the amount within the toilet bowl is usually less than one half gallon.

Therefore, another drawback of the prior art is that it dispenses concentrated liquid into the flush tank, where it becomes highly diluted. This results in very weak cleaning, disinfecting and deodorizing actions taking place in both the flush tank and the toilet bowl rather than the desirable relatively strong actions of this type taking place in the toilet bowl, where they are really needed. Also, since the dispensing of liquid commences at the beginning of the flush cycle, much of this liquid is wasted by being passed through the bowl.

Often a pellet or container of freshener is provided in the toilet tank. When the tank fills or empties with water, the freshener is released and diluted by the tank water and then discharged into the toilet bowl during each flush. Such conventional fresheners are less than completely satisfactory since they are rapidly consumed when wetted and dissolved by the full amount of fresh water used to flush the bowl.

Therefore, in view of the foregoing it is clear that a need exists for an improved chemical dispenser mechanism for use with toilet tank combinations which solves the problems of the prior art and eases the unpleasantries associated with the cleaning, disinfecting and deodorizing of toilet bowls.

SUMMARY OF THE INVENTION

In accordance with this invention I have provided a toilet cleaner controller device readily incorporated into a toilet tank having a customary float operated fill device functioning after a flush to automatically refill the tank with water to a selected level. In such tank it is conventional to utilize an overflow pipe connected to deliver water to the toilet bowl, with the refill device having a relatively small water-supplying pipe customarily serving to supply water to the overflow pipe during the procedure in which the tank is refilled. This flow of water into the overflow pipe serves the desirable purpose of establishing a selected amount of water in the toilet bowl after each flush.

My novel toilet cleaner controller device has therein a reservoir adapted to receive either a liquid cleaner or else compressed cleansing tablets designed to slowly dissolve in water. The reservoir is connected to receive water from the water-supplying pipe of the float operated fill device, such that during the procedure in which the tank is refilled, a suitable amount of concentrated cleansing solution created in the reservoir will be delivered to the toilet bowl or to the tank and bowl.

As a consequence of this arrangement, when the float operated fill device causes the refilling of the tank to commence, some water from the fill device will be delivered to the reservoir of my novel device, causing the dispersal of a suitable amount of cleansing and/or disinfecting solution into the toilet bowl, or into the tank and bowl, as the user may elect.

A distribution valve is operably positioned in my novel controller device and connected to the reservoir. The distribution valve may have a pair of outlet ports, with the arrangement being such that from the first outlet port, concentrated cleansing solution can flow to the overflow pipe, and thence into the toilet bowl.

The distribution valve contains a rotary valving member positionable by a control knob, with the rotary valving member being movable in a range of positions between a position permitting concentrated cleansing solution to flow relatively freely from the reservoir to the overflow pipe, to a position enabling a diminished flow, and eventually to a position entirely shutting off the flow of concentrated cleansing solution to the overflow pipe. From the second outlet of the distribution valve, cleaning and disinfecting solution can selectively flow into the toilet tank.

It is a primary object of this invention to provide a non-complex, easily affordable toilet cleaner controller device readily installed in a toilet tank, which device is designed to receive a substantial quantity of either compressed tablets or liquid disinfectant, thus to provide a cleansing action for the toilet bowl over a protracted length of time, with the rate at which cleansing solution is admitted to the toilet bowl and/or to the toilet tank being selectively controllable by the user.

It is another object of this invention to provide a toilet cleaner controller device that can be readily added to an existing toilet tank by even an inexperienced user, with the user being provided a means whereby cleaning and/or disinfecting solution emanating from the controller can be selectively delivered only to the toilet bowl, or as an alternative to the tank and bowl, with the rate at which the solution is administered able to be readily controlled.

It is yet another object of this invention to provide a toilet cleaner controller device for utilization in a conventional toilet tank, which device is able to be manufactured at low cost, easily kept in good repair, and designed to spare the user the burden of frequently having to add more compressed tablets or cleansing solution to the toilet tank.

It is yet still another object of this invention to provide a toilet cleaner controller device designed to receive a substantial number of compressed cleanser tablets, thus to provide a consistent cleansing action for a toilet bowl that extends over a substantial period of time, with this arrangement serving the additional purpose of preventing a broken compressed tablet from ever being in a position to interfere with a proper closure of the flapper valve of the tank.

It is a further object of this invention to provide a toilet cleaner controller device designed to receive a number of compressed cleaning tablets, which device is readily connected with the conventional float control device utilized for maintaining the water in the tank at a desired level, such that the water typically delivered to the upstanding overflow pipe of the toilet tank is instead delivered directly to my novel cleaner controller device, thus to bring about the subsequent administration of a consistent amount of cleansing solution directly to the upstanding overflow pipe of the toilet.

It is a yet further object of this invention to provide a toilet cleaner controller device having a reservoir designed to receive either a quantity of compressed cleaner tablets or a concentrated liquid cleaning solution, with an operating knob conveniently accessible to the user enabling him or her to rotate the knob in order to easily compensate for different strengths of cleaning ingredients utilized in the reservoir, as well as to make compensatory adjustments to reflect the strength of the cleaning effort needed for the toilet at a given time.

These and other objects, features and advantages will become more apparent from an inspection of the appended drawings.

BRIEF DESCRIPTION OF THE DRAWINGS

FIG. 4 is a type of exploded view in which the distribution valve housing is shown above the portion of my novel toilet cleaner controller device in which it normally resides, and with this view further illustrating the rotary valve member removed from the distribution valve housing;

FIG. 5 is a side elevational view in which the sidewall of the distribution valve housing has been cut away in order to reveal the rotary valving member in one of its operative positions;

FIG. 8 is a perspective view of another embodiment of the control housing of my controller device, showing a configuration of the housing readily permitting the addition of lubrication to the interior of the housing and the rotary valving member, should such lubrication be needed; and FIG. 9 reveals to a relatively large scale, the interior of the reservoir portion of my novel device, including the preferred entry location for the concentrated solution to be supplied from the reservoir to the adjacent rotary valve member.

DETAILED DESCRIPTION

Figure 1:
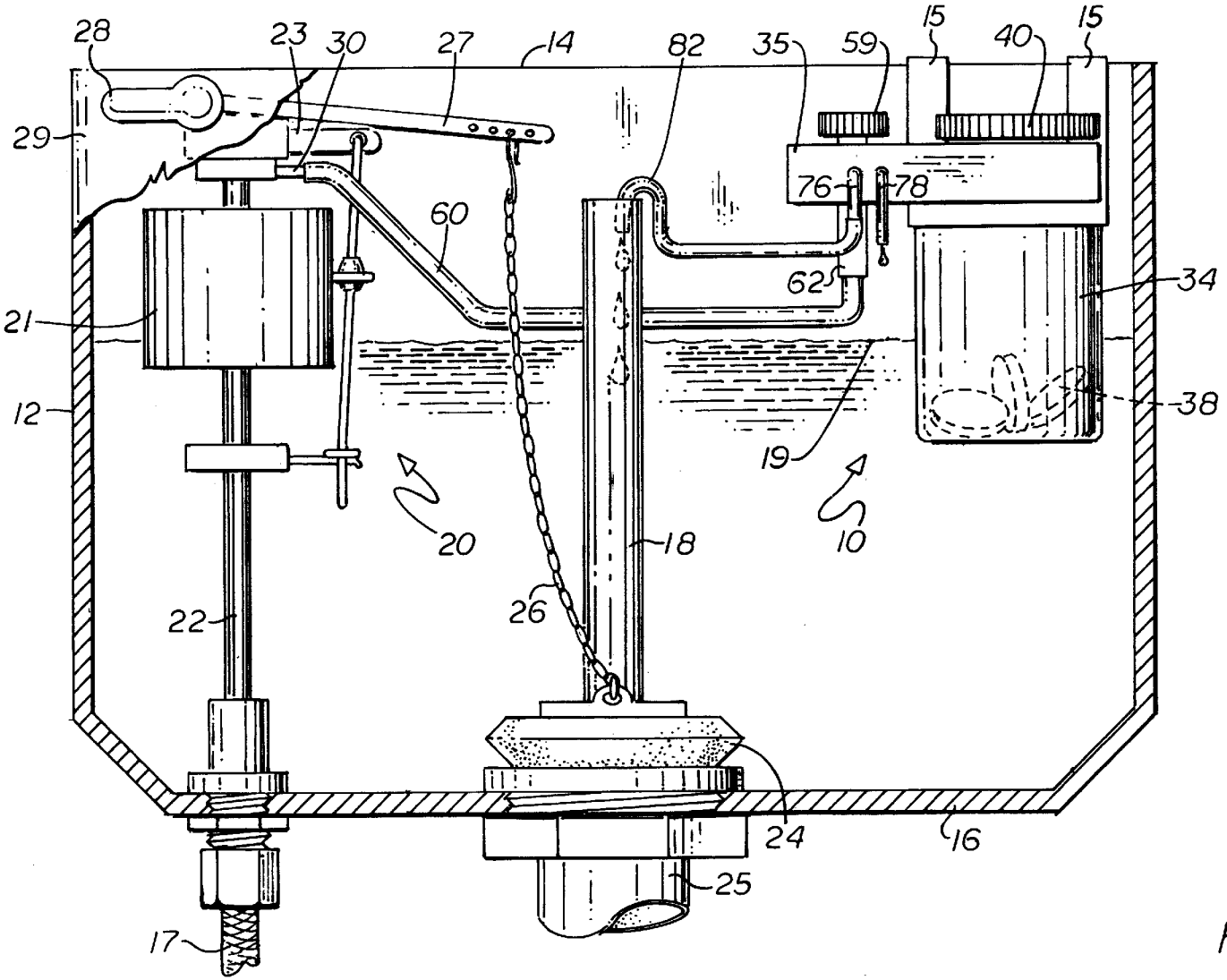
FIG. 1 is a somewhat simplified showing of the water tank associated with a conventional flush toilet, with my novel toilet cleaner controller illustrated at one side of the tank, and with this view depicting the manner in which the controller is connected to certain of the customary components of the toilet tank.

With initial reference to FIG. 1 it will be seen that I have shown my novel toilet cleaner controller device 10 in the environment of a toilet tank 12, with the tank shown in a somewhat simplified manner in order to reveal the preferred attachment of the toilet cleaner controller device 10 with regard to certain conventional components of the toilet tank. The tank 12 is shown to have a top edge 14 and a bottom wall 16, with water, such as from a municipal source, being supplied at the bottom of the tank by the fresh water supply pipe 17. An upstanding overflow pipe 18 is attached to and supported by the bottom wall 16 of the tank 12. In a conventional manner the overflow pipe 18 is connected to the toilet bowl (not shown), such that the water entering at the top of the pipe 18 flows essentially directly down into the toilet bowl. A relatively large pipe 25 leading to the toilet bowl is attached to the bottom wall 16 of the tank in the manner shown in FIG. 1.

The amount of water entering the tank 12 is controlled by a conventional float operated fill device or float operated control device 20, such as made by Fluid Master of Anaheim, Calif., although it is obvious that I am not to be limited to such device or to the products of such company.

As will be noted from FIG. 1, a float 21 is operatively mounted on the upstanding shaft or hollow post 22 of the fill device 20, with the float traveling upwardly or downwardly on the post 22, in a conventional manner, as the water level in the tank 12 changes. The float 21 is connected to a lever 23 operatively mounted on the top of the device 20. The end of the lever 23 remote from the float 21 directly controls, in a well-known manner, the inflow of fresh water to the tank 12 through the pipe 17 and the interior of hollow post 22.

The previously mentioned overflow pipe 18 is shown directly behind the flush valve 24, preferably a flapper type. The edge of the valve 24, when lifted, permits the water contained in the tank 12 to run down through large pipe 25 into the toilet bowl, to accomplish a flushing of same. A chain 26, also of conventional construction, is attached to the edge of the flapper valve 24, with the upper end of the chain being attached to the lever 27. The end of the lever 27 remote from the chain attachment point is firmly attached to the flush handle 28, which is understood to be operatively mounted on the front wall 29 of the tank 12. As is obvious, upon the handle 28 being manipulated by a user to cause the lever 27 to move upwardly, the chain 26 causes the flapper valve 24 to lift temporarily off its seat, to permit the water in the tank 12 to run, under the influence of gravity, down through the relatively large pipe 25 into the toilet bowl. Afterward, the flapper valve 24 reseats, largely under the influence of gravity, permitting the tank to refill with water.

As mentioned hereinabove, the float control device (float operated fill device) 20 is of conventional construction and is utilized for causing fresh water to be admitted via pipe 17 and hollow post 22 to the tank 12 immediately after a flush, with the device 20 automatically serving to control the depth of water to be maintained in the tank 12. In other words, the float control device functions to admit water, typically from a municipal source, into the tank 12 until the established water level has been reached. A typical water level is indicated at 19 in FIG. 1.

The novel toilet cleaner controller device 10 provided in accordance with this invention is typically a multi-compartmented device supported by one or more hooks 15 from the top edge 14 of the toilet tank, with the device 10 normally residing partially submerged in the water contained in the tank 12, as indicated in FIG. 1. The device 10 will shortly be described with regard to its individual components.

Returning to the details of the basic toilet tank, the inflow of water to the tank 12 from the municipal source is controlled, as mentioned hereinabove, in a conventional manner by the above-mentioned float control device 20. It is important to note that the float control device 20 includes a small water-supplying pipe 30 of the type conventionally utilized for supplying controlled amounts of water to the overflow pipe 18 during the refilling of the tank 12 after a flush. This type of arrangement has become customary in order that a desirable amount of water will be supplied to, and retained in, the bottom of the toilet bowl subsequent to each flush. Were it not for this customary feature, no water would be retained in the toilet bowl, even though the toilet tank has been refilled.

It is to be understood that if the instant invention, involving the novel controller device 10, were not being used in the tank 12, fresh water would be normally supplied directly to the overflow pipe 18 from the small water-supplying pipe 30 so that an appropriate amount of water will be furnished to the toilet bowl subsequent to each flush. As will be seen hereinafter, water containing a selected concentration of cleansing and/or disinfecting solution will advantageously be directed, in accordance with this invention, into the overflow pipe 18 and thence into the toilet bowl after each flush, to assure the continuing cleanliness of the toilet bowl.

Figure 2:
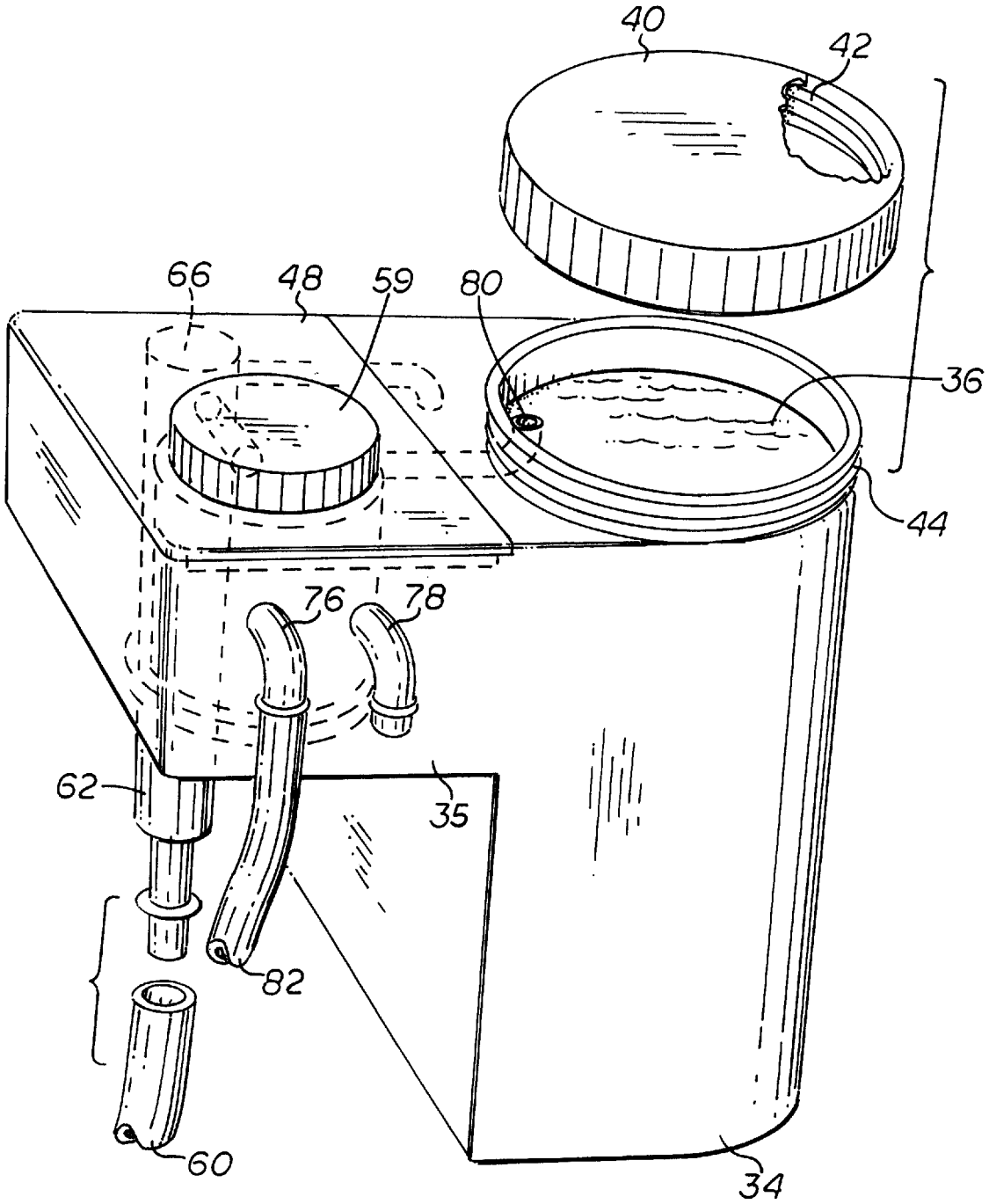
FIG. 2 is a perspective view showing the exterior of my novel toilet cleaner controller device, upon which phantom lines have been applied in order to reveal certain internal detail.

Turning now to the details of the toilet cleaner controller device 10 provided in accordance with this invention, it will be noted from FIGS. 1 and 2 that my controller device involves a housing member 34 constructed, for example, of industrial grade plastic. An upper portion 35 of the housing member 34 contains a water distribution valve, described hereinafter. The compartmentation of the housing member 34 may be accomplished by the utilization of a partition 72 (see FIG. 3) so that a reservoir 36 will be defined that occupies a major portion of the interior of the housing 34. Into the reservoir 36 either a liquid cleaner or else a plurality of compressed cleansing tablets 38 are to be added; note FIG. 1. As will shortly be made clear, the tablets 38 are utilized for creating a concentrated cleansing and/or disinfecting solution in the reservoir 36, which solution is employed in a carefully controlled manner for a highly effective, ongoing cleaning of the toilet bowl.

FIGS. 1 and 2 will be noted to reveal an upper closure provided for the reservoir 36, preferably in the nature of a circular cap 40 equipped with internal threads 42. These threads 42 are designed to tightly engage the upstanding threads 44 shown in FIG. 2 on the top of the housing 34 directly above the reservoir. After the liquid cleaner or the concentrated, compressed tablets have been added to the reservoir 36, the closure 40 is carefully tightened onto the external threads 44 inasmuch as the reservoir 36 is to be kept entirely full of cleansing fluid during use. It is to be understood that the reservoir must be able to withstand a certain amount of internal pressure in order to be leak free for proper operation.

Figure 3:
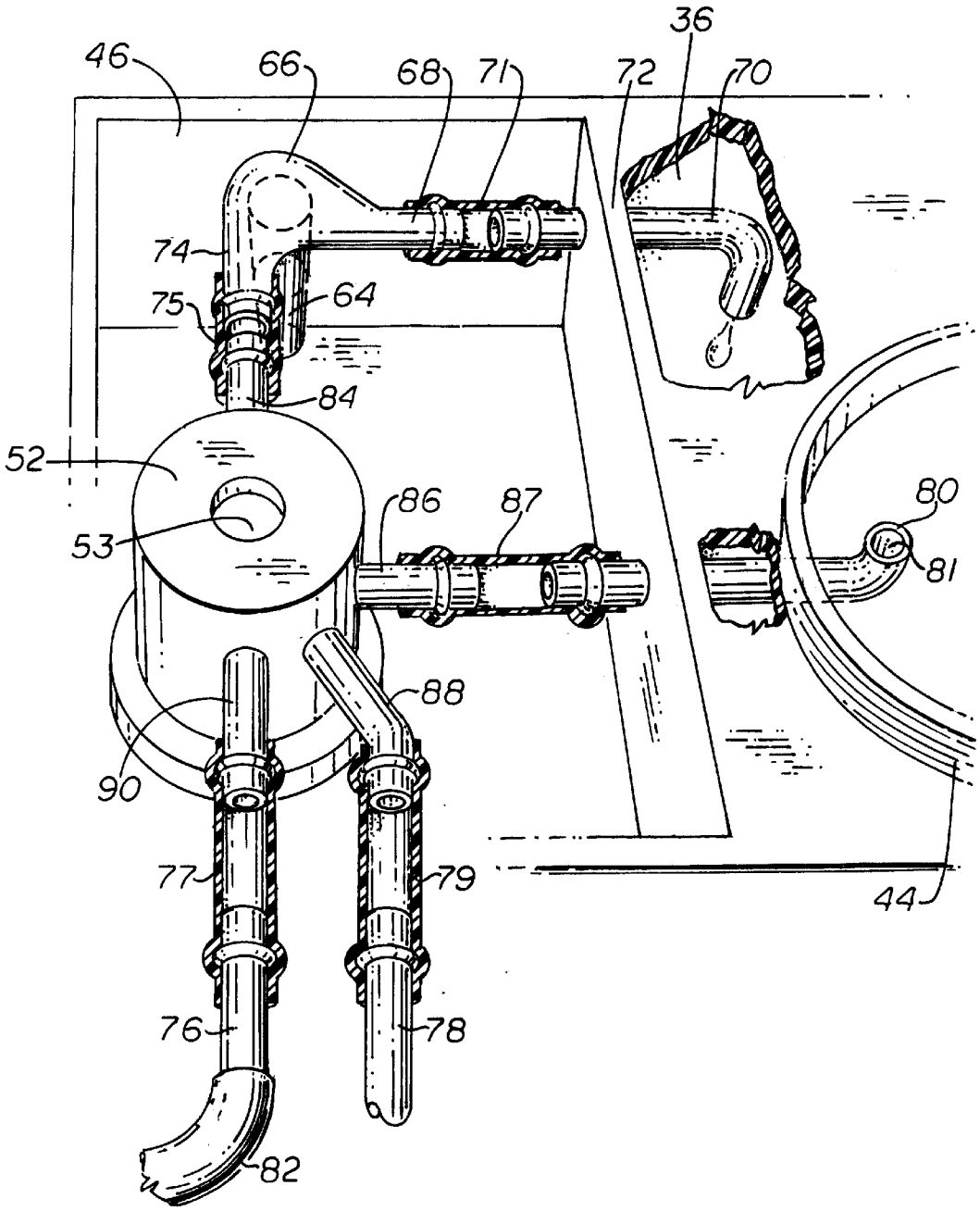
FIG. 3 is a perspective view in which the connections to the distribution valve housing are depicted in a somewhat exploded relationship.

FIGS. 1 and 2 also reveal that an upper portion of the housing member 34 represents the distribution valve portion 35 of my device, with the distribution valve portion noted to reside alongside the reservoir 36. Inside the distribution valve portion 35 of the device 10 is mounted the distribution valve housing 52. The device 52 is to be regarded as a component having multiposition capabilities and is equipped with a plurality of outlets, as best seen in FIG. 3. Inside the housing 52 a hand operated rotary valving member 54 is operatively installed; note FIGS. 4 and 5.

As will be hereinafter explained in some detail, the circularly shaped rotary valving member 54 is a multiposition device in that it can be moved to multiple positions, and by the user bringing about an appropriate rotation of the member 54, it is possible for the user to selectively control the concentration of the flow of cleansing fluid into the toilet bowl as well as into the tank 12.

As to the construction of the rotary valving member 54, in some instances it may be made of an industrial grade plastic carefully fitted, in a leak-free manner, into the interior of the housing member 52, so as to properly cooperate with the inlet and outlet connections of the housing member. I am not to be limited to a construction involving plastic, however, and in other instances it may be desirable to construct the rotary valving member of a non-rusting metal, such as stainless steel. Should stainless steel be used in the construction of the rotary valving member 54, it is necessary for it to be carefully fitted in a leak-free manner in the interior of the housing member 52, and in addition it may well be desirable to provide lubrication for this type of valving member 54. The utilization of a suitable means for adding lubricant to the device from time to time is revealed in conjunction with the embodiment of this invention depicted in FIGS. 8 and 9.

The reservoir 36 is normally kept entirely full of cleansing fluid, as previously mentioned, with a desirable supply of water to the reservoir being accomplished by eliminating the customary connection of the small water-supplying pipe 30 to the top of the overflow pipe 18, and substituting tubing 60 leading from the small water-supplying pipe 30 to a fitting 62 on the underside of the portion 35 of the housing member 34; note FIGS. 1 and 2. In this way, each time the toilet is flushed, additional water is delivered to the reservoir 36. As shown in FIG. 5, an anti-syphon valve 64 may optionally be utilized in the fitting 62.

With particular reference to FIG. 3, it will be noted that output from the anti-syphon valve 64 is delivered to a lower portion of a T-type fitting 66. It is thus to be seen that water from the basic water supply is delivered from the small water-supplying pipe 30 of the float control device 20, via tubing 60 and the optionally utilized anti-syphon valve 64, to the bottom of the T-type fitting 66. The fitting 66 has a pair of upper arms, arms 68 and 74, such that water can flow in two directions. Water flowing from arm 68 of the fitting 66 is delivered to a fitting or small pipe 70 installed in a leak free manner in the sidewall or partition 72 separating the reservoir 36 from the distribution valve portion of the housing. It is to be understood that the connection between pipe 68 and pipe 70 may be readily accomplished by the utilization of a short piece of tubing 71.

On the other hand, water flowing from arm 74 of the fitting 66 is delivered as fresh water to the fitting 84 attached to the sidewall of the housing 52 of the multiposition distribution valve. A connection between pipes 74 and 84 may be readily accomplished by the use of a short piece of tubing 75. Suitable clips or clamps may be used for assuring that the short pieces of tubing 71 and 75 remain connected in a leak-free manner to the respective pipes with which they are used.

It is to be noted that a pipe or fitting 80 installed in the partition or sidewall 72 of the housing member 34 is utilized for delivering concentrated cleansing and/or disinfecting solution created in the reservoir 36 from the top surface of the reservoir to the fitting 86 of the housing 52 of the multiposition distribution valve. For reasons made clear hereinafter, the end of pipe 80 remote from the distribution valve housing is upturned, with this upturned end being located only slightly below the underside of the closure cap 40 when the cap has been firmly tightened, in a leak-free manner, on the upstanding threads 44; note FIG. 9.

A short piece of tubing 87 may be utilized to interconnect the pipes or fittings 80 and 86. Except for the fittings or small pipes 70 and 80, it is to be understood that the reservoir 36 is entirely separated, in a liquid-tight manner, from the portion of the housing member 34 in which the housing 52 of the distribution valve is located. The operation of the distribution valve will be described in detail shortly.

As will be noted from FIGS. 1 through 3, small pipes 76 and 78 lead outwardly from the distribution valve portion 35 of the housing member 34. Pipe 76 is seen in FIG. 3 to be connected by means of a short piece of tubing 77 to a pipe or fitting 90 mounted on the sidewall of the distribution valve housing 52. The pipe or fitting 90 will be hereinafter referred to as the outlet port of the multiposition distribution valve. The pipe 78 is seen in FIG. 3 to be connected by means of a short piece of tubing 79 to a pipe or fitting 88, also located on the sidewall of the distribution valve housing 52. The pipe or fitting 88 will hereinafter be referred to as the second outlet, and it will be noted that fitting 88 is mounted on the sidewall of the housing member 52 at a distinctly different location or rotative position than the fitting 90.

It is to be understood that tubing 82 is inserted on the outer end of the small pipe 76, whereas the pipe 78 is arranged to deliver its contents directly into the tank 12; note FIG. 1. It is important to note that the tubing 82 connected to the pipe 76 serves the very significant function of carrying the concentrated cleaning solution from the distribution valve housing 52 to the overflow pipe 18 and thence via large pipe 25 into the bowl of the toilet. This important detail is illustrated in FIG. 1.

It was of course to be noted from FIG. 3 that for reasons of clarity I have shown the relationship of the distribution valve housing 52 to the various connections made thereto, whereas in FIG. 4 I have depicted, by means of an exploded relationship, the components that constitute the distribution valve arrangement.

FIG. 3 reveals a hole 53 provided in the upper central portion of the distribution valve housing 52, through which extends the shaft 58 of a knob 59 utilized for positioning the rotary valving member 54; note FIG. 4. The knob 59 is shown in its operative position in FIG. 5, whereas in FIG. 4 it has been shown in an exploded relationship to the distribution valve housing 52. It is to be understood that the shaft 58 on the underside of the knob 59 is designed to closely interfit with the splined member 55 atop the rotary valve member 54, so that selective rotation of the rotary valve member may be readily accomplished. The valving member 54 will shortly be discussed in substantial detail.

With particular reference to FIGS. 4 and 5, it will be noted that I have revealed in each of these figures a pair of elongate apertures 56*c* and 56*d* residing in the curved sidewall of the rotary valving member 54, and it is to be understood that these are but two of the multiple elongate apertures disposed about the periphery of the rotary valving member 54. As will shortly be made clear, the positioning of the elongate apertures of the valving member 54 determines the extent of flow into the previously mentioned fluid outlet connections 88 and 90 that are mounted in a spaced relationship upon the circumference of the distribution valve housing 52.

FIG. 4 in showing the distribution valve and its related components in an exploded relationship is helpful in explaining that the rotary valve member 54 resides in a rotatable manner inside the distribution valve housing 52. The particular orientation of the multiposition valving member 54 at a given point determining the manner in which the concentrated solution from the reservoir 36 is distributed to the toilet components.

At the lower portion of FIG. 4 I have shown a preferred configuring of the interior portion 45 of the upper portion 35 of the housing member 34, such that the distribution valve housing 52 can be received therein and held firmly in the proper position by suitable fasteners. Access to the interior portion 45 is provided by an aperture 46 in the upper surface 47, which aperture is of a size to permit the ready insertion of the distribution valve housing 52. Arranged to fit closely in the upper aperture 46 is a generally rectangularly shaped closure plate 48, clearly shown in FIG. 4 as well as in FIG. 2, with it to be noted that a flanged edge 49 of the closure plate is arranged to fit closely around the contour of the aperture 46. A hole 50 in the center of the closure plate 48 is arranged to coincide with the location of the previously-mentioned hole 53 located in the top of the distribution valve housing 52. The shaft portion 58 of the knob 59 is understood to be long enough to extend through the aligned holes 50 and 53 and then make effective contact with the fitting 55 atop the rotary valve member 54, when the valve member 54 is residing in its installed location in the interior of distribution valve housing 52.

As should now be clearly apparent, the rotation of the knob 59 by the user will bring about rotation of the rotary valve member 54 such that the desired apertures of the multiposition valve member are brought into operative contact with the pipes or fittings arrayed around the periphery of the distribution valve housing 52. In this way the user can select the strength of the cleaning and cleansing solution directed in a particular instance into the toilet bowl, or into the tank and bowl.

With further reference to FIG. 4, it will be noted that I have created a plurality of straight sided holes 51 in the bottom of the upper housing portion 35. The distribution valve housing 52 is provided on its underside with a series of threaded holes 51*a*, with these holes 51*a* being created so as to be capable of alignment with the unthreaded holes 51 disposed around the lower portion of the housing 52. I prefer to utilize a toroidally shaped gasket 61 between the housing 52 and the inner mounting surface of upper portion 35. In this way the distribution valve housing 52 can be secured firmly in position, in the manner indicated in FIG. 5. As is obvious, should any difficulty ever arise with the rotary valving member 54, it is but a relatively simple matter to remove the knob 59 and the closure plate 48, and to loosen the screws extending upwardly through holes 51 into engagement with the threaded holes 51*a*. The loosening and removal of these screws will of course enable the distribution valve housing member 52 to be removed such that both the housing member as well as the rotary valve member 54 can be replaced, although in many instances it will be unnecessary to replace both of these members.

FIG. 5 is to be seen as revealing the distribution valve housing 52 in its fully assembled relationship with the upper portion 35 of the housing member, with of course the closure plate 48 residing upon the upper surface 47. Also visible in FIG. 5 is the optionally utilized spring loaded anti-siphon valve 64 which, as previously mentioned, connects to the lower arm of the T-type fitting 66. It is of course to be understood that the anti-siphon valve 64 is not located on the axis of the multiposition valve member 54, as it would seem in FIG. 5 to be located. Rather, the member 64 is located in a position behind the rotary valve member 54, as is made clear from an inspection of FIGS. 2 and 3. Connected to the fitting 62 located below the anti-syphon valve 64 is one end of tubing 60, with the other end of tubing 60 being connected to the small pipe 30 depicted in FIG. 1. It is through the tubing 60 and the T-type fitting 66 that fresh water is supplied to my novel toilet cleaner controller device 10 with each flush of the toilet, accomplished in the manner previously described.

From the foregoing it should now be clear that fresh water is supplied by tubing 60 to the bottom portion of the T-type fitting 66, with the water being supplied by arm 68 to the pipe or fitting 70 disposed in the sidewall 72 of the reservoir 36, and by arm 74 to the fresh water intake pipe 84 of the distribution valve housing 52. Concentrated cleaning solution from the reservoir 36 is connected by fitting 80 to intake fitting 86 of the distribution valve housing 52. By the user positioning the knob 59 and therefore the rotary valving member 54 in one particular position, he or she can cause the concentrated solution to be directed through the fitting 90, the short pipe 76 and tubing 82 to the overflow pipe 18 and thence to the toilet bowl; note FIG. 1. On the other hand, by differently positioning the knob 59, the multiposition rotary valving member 54 can cause concentrated cleaning fluid to be delivered to the tank 12 as well as to the bowl of the toilet. The user can also control the concentration of the cleansing solution directed to the bowl and to the tank. Further details will shortly be discussed at greater length.

Turning now to related FIGS. 6*a*, 6*b*, 6*c* and 6*d*, it will be seen in all of these figures that the distribution valve housing 52 is depicted as a circle, which closely surrounds the rotary valve member 54. Shaded portions of the valve member 54 indicate closed peripheral portions of the valve member 54, whereas unshaded portions indicate openings in the periphery of the rotary valve member 54, such as the elongate apertures 56*c* and 56*d* mentioned in connection with FIGS. 4 and 5.

In each of the FIGS. 6*a* through 6*d* it will be seen that fresh water delivered by T-shaped fitting 66 is supplied to arm 68 leading to the reservoir 36, and to supply pipe 84 shown at what may be regarded as the 12 o'clock position on the distribution valve housing 52. The pipe 86 that is placed to receive the concentrated cleansing solution from the reservoir 36 is located at approximately the 2:30 o'clock position on the distribution valve housing 52. Fitting or pipe 88 is one of the outlets and is utilized for delivering the concentrated cleaning solution from the distribution valve directly to the tank 12, with the fitting 88 being placed at approximately the 4:30 o'clock position on the distribution valve housing 52. The pipe 90 utilized for delivering the concentrated solution to the short tube 76, and thereafter to the tubing 82, is placed at approximately the 6 o'clock position on the distribution valve housing 52. It was seen in FIG. 1 that the tubing 82 delivers the concentrated solution to the upstanding overflow pipe 18, from which the concentrated solution is of course delivered directly to the toilet bowl via the relatively large pipe 25 on the underside of the tank 12.

Figure 6A:
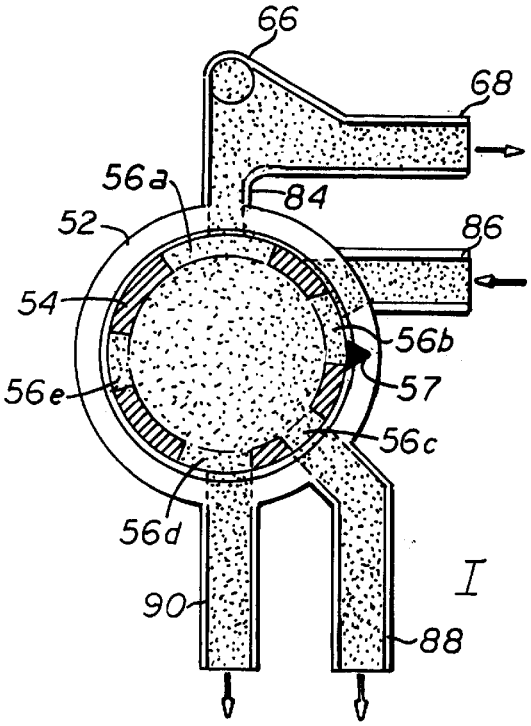
FIGS. 6*a*, 6*b*, 6*c* and 6*d* reveal a diagrammatic series of views, with each of these views showing a particular positioning of the rotary valving member with respect to its housing, with each of these positions serving to depict a distinct flow of cleansing solution to the various toilet components.

Now with particular reference to FIG. 6*a*, it will be seen that at approximately the 3:00 o'clock position, a marker or indicia 57 is provided, which in this instance is in what I prefer to call Position I of the rotary valve member 54. It will here be seen that the multiposition valving member 54 has been positioned with respect to the housing 52 such that aperture 56*a* is in alignment with the fresh water connection 84, thus enabling water to flow into the interior of the rotary valve member 54.

With the marker or indicia in Position I it will be seen that aperture 56*b* of the valve member 54 is in general alignment with the connection 86, thus permitting concentrated cleaning solution from the reservoir 36 to flow into the interior of the rotary valving member 54. At this same time, aperture 56*c* is in substantial alignment with the fitting or connection 88, and aperture 56*d* is in substantial alignment with fitting or connection 90. Therefore, as a result of the placement of the rotary valving member 54 in Position I, the cleansing solution from the reservoir can flow via fitting 88 (and the short pipe 78) directly into the tank 12. Furthermore, this positioning of the rotary valving member 54 simultaneously permits the cleansing solution to flow via the fitting 90, the short pipe 76 and the tubing 82 to the overflow pipe 18. It is thus to be seen that in accordance with the positioning of the rotary valve member 54 in Position I, the cleansing solution reaches both the tank 12 as well as the toilet bowl.

With continuing reference to FIG. 6*a*, and as will be discussed at greater length hereinafter, the user can move the multiposition valving member 54 incrementally with regard to the inlet and outlet ports operably connected to the housing member 52. In other words, by slight rotative adjustments of the knob 59, the user can cause the concentration of the cleansing solution flowing to the tank and bowl to be modified. For example, if the knob 59 is rotated to some extent in the clockwise direction, this causes rotation of the rotary valve member 54 in such a manner as to diminish somewhat the amount of concentrated flow entering the aperture 56*b* from the pipe or fitting 86. At the same time this rotative motion serves to diminish somewhat the amount of flow leaving the aperture 56*c* and flowing into the pipe 88, as well as to diminish somewhat the amount of flow leaving the aperture 56*d* and flowing into the pipe 90. From this it should be clear that the user is able to readily control the concentration of the cleansing fluid flowing to the tank 12 and to the toilet bowl by appropriate rotative adjustments of the knob 59, with the particular positioning of the multiposition valve 54 in a given instance causing the solution to be relatively strong or relatively weak.

Figure 6B:
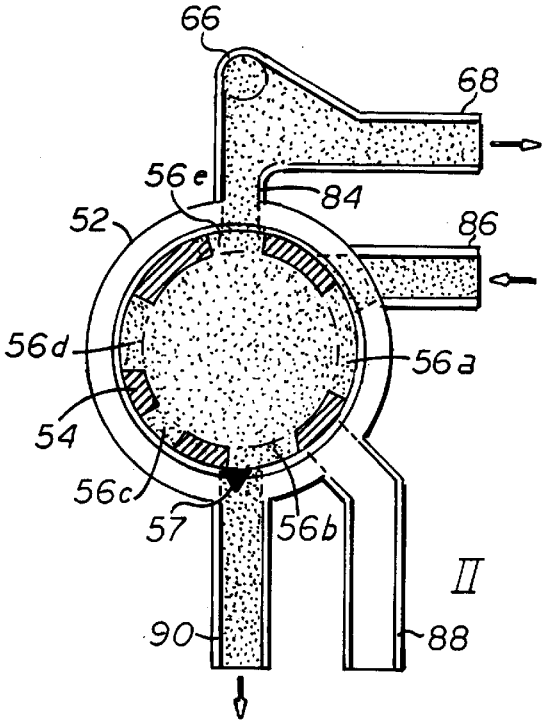

Turning now to FIG. 6*b*, it will be noted that the marker or indicia 57 has been moved to what may be regarded as the 6:00 o'clock position, which I prefer to describe as Position II. In this instance, the rotary valving member 54 has been rotated such that aperture 56*a* is in position to receive concentrated solution from the reservoir 36 via the fitting or connection 86, such that the concentrated solution can flow into the center of the rotary valving member 54. This orientation of the rotary valving member 54 has brought aperture 56*b* into substantial alignment with the fitting 90 connected to cause the concentrated solution to be delivered via tubing 82 to the upstanding overflow pipe 18. Fresh water from pipe 84 continues at this point to enter the rotary valving member through aperture 56*e*.

It is important to note, however, that when the rotary valving member is in the position depicted in FIG. 6*b*, a sidewall portion of the rotary valving member 54 in effect serves as an obstruction blocking the flow of cleansing solution into fitting 88, with the result that no concentrated solution is in this instance delivered to the toilet tank 12. In other words, when the indicia 57 is in Position II, concentrated solution is delivered to the toilet bowl but not to the toilet tank 12.

As discussed in connection with FIG. 6*a*, the user, by slight rotative adjustments of the knob 59 in the clockwise direction, can cause rotation of the rotary valve member 54 in such a manner as to diminish somewhat the amount of concentrated flow entering the valve member 54 through the aperture 56*a* from the pipe or fitting 86, thus to cause a diminishment of the flow of concentrated solution leaving the valve member 54 through the pipe or fitting 90. By appropriate rotation of the valving member 54 in this manner, the user can readily cause the cleansing solution entering the toilet bowl to be relatively strong or relatively weak, depending upon the particular positioning of the knob 59.

Figure 6C:
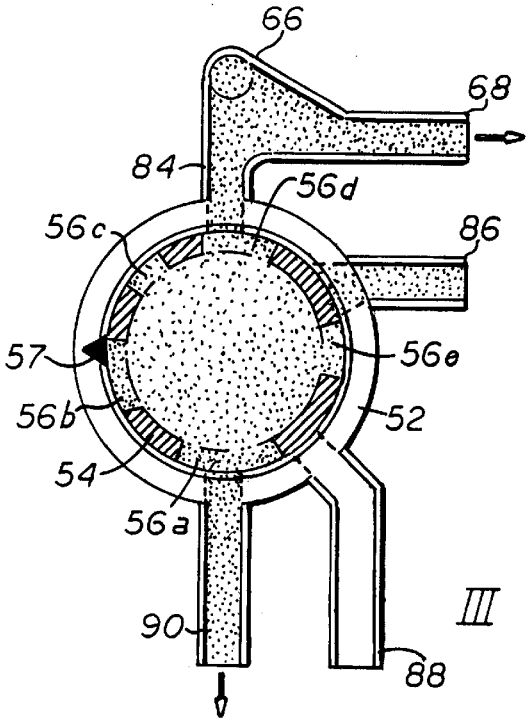

With reference now to FIG. 6*c*, it will be noted that the marker or indicia 57 has been moved around to Position III, which is approximately at the 9:00 o'clock orientation. In this instance a sidewall of the rotary valving member 54 has rotated around so as to block the entry of concentrated solution from the reservoir 36 via the pipe or fitting 86 into the interior of the rotary valving member. Also blocked is any connection from the interior of the rotary valve member 54 to the pipe or fitting 88 leading to the tank 12. However, aperture 56*d* of the rotary valving member is in alignment with the fresh water supply fitting 84, which means that fresh water can enter the interior of the rotary valving member 54, and thereafter flow through aperture 56*a*, fitting 90 and small tubing 82 directly into the toilet bowl. It is understood that the rotary valving member 54 would be moved to Position III when, for example, repairs are to be made on the toilet and it is desirable to avoid wasting the concentrated solution emanating from the reservoir 36.

Figure 6D:
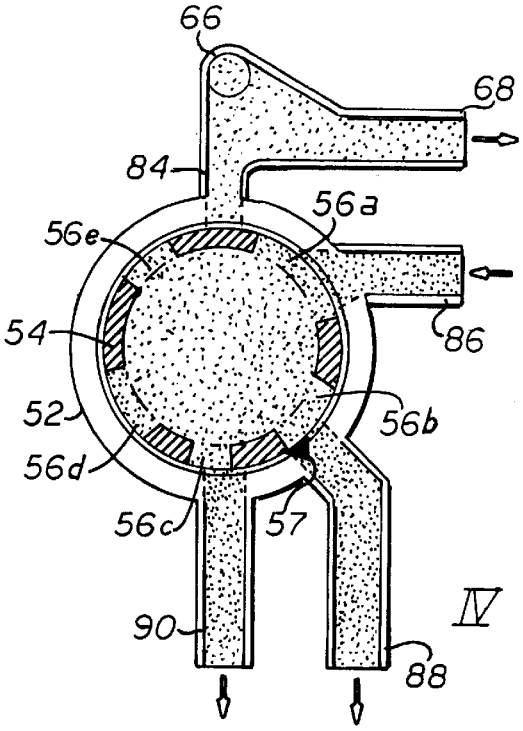

With reference now to FIG. 6*d*, it will be noted that rotation of the rotary valve member 54 into Position IV has taken place, with the marker or indicia 57 being in this instance located in approximately the 5:00 o'clock position. In Position IV a portion of the rotary valve member serves to block the entry of fresh water into the valve member 54 via the pipe or fitting 84, but the flow of fresh water into the reservoir 36 at the time of the next flush of the toilet will still take place. In this position of the valving member 54, the entry of concentrated solution into the interior of the rotary valve member 54 through the pipe or fitting 86 and the aperture 56*a* takes place. As will be noted from FIG. 6*d*, this positioning of the rotary valve member is such that the concentrated solution can flow via aperture 56*b* into the pipe 88, and via aperture 56*c* into the pipe 90, thus permitting the concentrated solution to be directed into the tank 12 as well as into the toilet bowl. Movement of the rotary valve member into Position IV may be indicated from time to time, in order to accomplish a particularly thorough and highly effective cleansing action.

Figure 7:
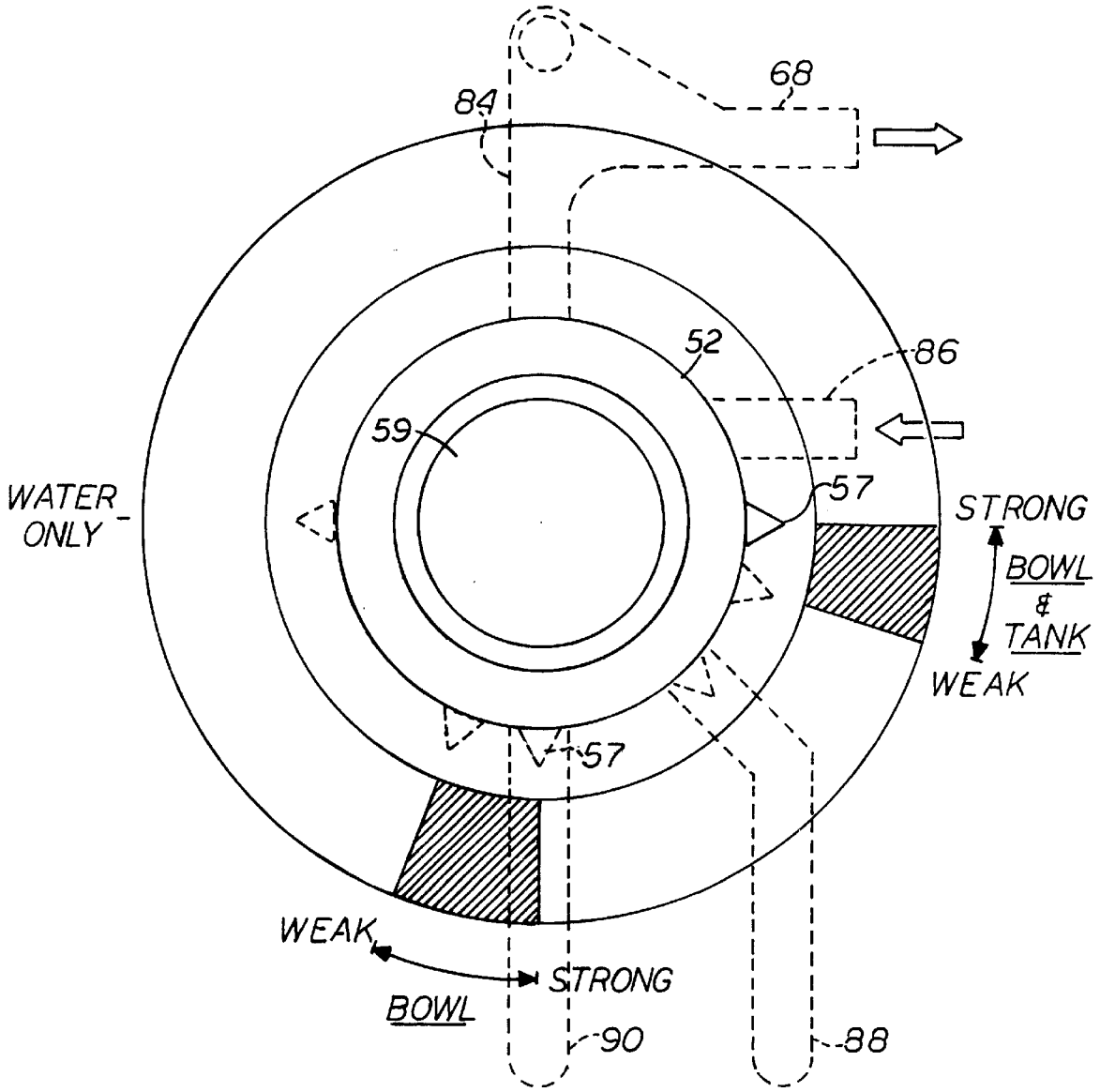
FIG. 7 is an enlarged diagram relatable to FIGS. 6*a* through 6*d* and showing in greater detail how it is readily possible for the user, by appropriate manipulation of the control knob, to select the strength of the cleansing solution being directed either to the toilet bowl, or simultaneously to the bowl and toilet tank.

Turning now to FIG. 7 it will be seen that I have revealed in greater detail and to a larger scale, a further illustration of the effect of relatively slight rotative movements of the knob 59. This figure may be regarded as a supplement to the discussion relative to FIGS. 6*a* through 6*d*. In FIG. 7 the inlet 84 for fresh water into the distribution valve is located at the top of this figure in what may be regarded as the 12:00 o'clock position; the inlet 86 for the concentrated solution is located at the 2:30 o'clock position; the outlet 88 from the distribution valve to the tank 12 is located at the 4:30 o'clock position; and the outlet 90 to the toilet bowl is located at the 6:00 o'clock position.

FIG. 7 shows in greater detail how, with the indicia 57 basically in the 3:00 o'clock position, the rotatable valve member 54 can be moved for a relatively small extent in the clockwise direction, and in doing so, change the flow of cleansing fluid to the bowl and tank from a relatively strong solution to a relatively weak solution.

Continuing with FIG. 7, when the indicia 57 is basically in the 6:00 o'clock position, the rotatable valve member 54 can be moved for a relatively small extent in the clockwise direction, and in doing so, change the flow of cleansing fluid to the bowl from a relatively strong solution to a relatively weak solution. It will be recalled from FIG. 6*b* that no cleansing fluid flows in this instance to the toilet tank 12.

With the indicia 57 in FIG. 7 located at the 9:00 o'clock position, only water is delivered to the bowl, as was explained in connection with FIG. 6*c*.

Reference to FIG. 8 reveals an embodiment of the distribution valve housing appropriate for use when the multipositionable valve member is of such construction as to need lubrication from time to time. If, as previously mentioned, the valving member 54 is constructed of industrial grade plastic, lubrication may not be needed, but if the valving member 54 is constructed of stainless steel, the occasional application of lubricant to the valve housing member may be necessary.

In FIG. 8 it will be seen that in this modified distribution valve housing 92, an enlargement 93 has been provided on one side, through which a suitable lubricant can be admitted from time to time, through a lower hole 94 in the housing. Apertures 95 and 96 in the interior of the enlarged portion 93, best seen in FIG. 9, make it possible for the lubricant to flow laterally into locations inside the housing 92 where friction between the exterior of the valving member 97 and the interior of the housing member 92 is likely to occur.

A screw 98 normally closes the lower hole 94, but this screw is removed at such time as the lubricant is to be admitted into the interior of the enlarged portion 93, and then tightly replaced when a sufficient amount of lubricant has been supplied.

With continuing reference to FIG. 9, it will be seen that I have shown the reservoir portion 36 in additional detail, at the bottom of which are located a number of concentrated, compressed cleanser tablets 38. Visible in this figure is the pipe or fitting 80 through which concentrated solution is delivered to the distribution valve housing 92 and the rotary valve member 97. Also visible in this figure is the pipe fitting 70 through which fresh water is delivered to the reservoir. The pipe 70 is typically turned downward, in this way causing a desirable amount of agitation of the concentrated solution in the immediate vicinity of the tablets 38. It is significant to note with regard to the pipe or fitting 80 utilized for delivering concentrated solution out of the reservoir, that this pipe or fitting 80 is turned upwardly, and spaced a relatively short distance below the underside of the circular closure 40. It is of course to be understood that the closure 40 has been tightened into a leak-free condition with respect to the upstanding threads 44.

Because the entry location 81 of the pipe or fitting 80 is disposed quite far above the bottom of the reservoir and relatively close to the underside of the closure 40, only a limited amount of the concentrated solution can flow through the fitting 80 into the rotary valve member before the level of the concentrated solution drops below the entry location 81. This arrangement may be utilized to eliminate any undesirable siphoning effect in an instance in which the earlier mentioned spring loaded anti-siphon valve 64 has not been utilized. In other words, if the outflow through the pipe 80 exceeds the inflow of fresh water through pipe 70, and the liquid level inside the reservoir drops below the entry location 81, no more of the concentrated solution will be drawn into the pipe or fitting 80 and delivered to the distribution valve housing 52 until the time of the next flush, at which time additional water from the small water-supplying pipe 30 is delivered via tubing 60 to the fitting 62 on the underside of the housing portion 35.

It should now be apparent that I have provided a non-complex, readily affordable toilet cleaner controller device readily installed in a toilet tank, which device is designed to receive a substantial quantity of either compressed tablets or liquid disinfectant, thus to provide a highly satisfactory cleansing action for the toilet bowl extending over a protracted length of time. When it is necessary to replenish the concentrated cleanser tablets or to add more liquid cleansing solution to the reservoir 36, this can be readily accomplished by loosening the closure 40, adding the tablets or liquid cleansing solution, and then retightening the closure 40. Most advantageously, my novel controller device makes it exceedingly convenient for a user to readily select the rate at which cleansing solution is admitted to the toilet bowl and/or to the toilet tank.

Although the principal embodiment of my invention is designed to be used with a float operated fill device utilizing a float vertically movable upon a post or column, my device could involve separable portions in which the reservoir intended to receive the compressed cleanser tablets is disposed in a different part of the tank than the rotary valve member.

I claim:

1. A toilet cleaner controller device for use in a toilet having a tank equipped with a fill device functioning after a flush to refill the tank with water to a selected level, with the toilet tank having an overflow pipe connected to deliver water to the toilet bowl and with the fill device having a water-supplying pipe customarily serving to supply water to the overflow pipe during the refilling of the toilet tank, said toilet cleaner controller device having therein a reservoir adapted to receive a cleansing chemical able to be dissolved in water, said reservoir having an inlet connection enabling it to be connected to receive water from the water-supplying pipe during the procedure in which the toilet tank is being refilled, so that a concentrated cleansing solution will be maintained in said reservoir, and a valve member operably associated with said controller device, connected to receive concentrated solution from said reservoir, said valve member having an outlet port, with said valve member enabling the flow of concentrated solution from said outlet port to the toilet to be readily controlled.

2. The toilet cleaner controller device as recited in claim 1 in which said valve member is a multiposition distribution valve operably positioned in said controller device, said multiposition distribution valve being positionable such that the strength of the cleansing solution can be readily modified, enabling a full strength solution or a diluted solution to be delivered to said outlet port, or the flow of the cleansing solution to said outlet port to be fully shut off.

3. The toilet cleaner controller device as recited in claim 2 in which said multiposition distribution valve also has a second outlet, said multiposition distribution valve being positionable by a user such that the cleansing solution can be delivered only to said outlet port, or to said outlet port as well as to said second outlet.

4. A toilet cleaner controller device for use in a toilet having a tank equipped with a fill device functioning after a flush to refill the tank with water to a selected level, with the toilet tank having an overflow pipe connected to deliver water to the toilet bowl and with the fill device having a water-supplying pipe customarily serving to supply water to the overflow pipe during the refilling of the toilet tank, the improvement comprising a toilet cleaner controller device having therein a reservoir adapted to receive a cleansing chemical able to be dissolved in water, said reservoir being connected to receive water from the water-supplying pipe during the procedure in which the tank is being refilled, so that a concentrated cleansing solution will be maintained in said reservoir, and a distribution valve operably positioned in said controller device and connected to said reservoir, so that the concentrated cleansing solution can be delivered to the interior of said distribution valve, said distribution valve having an outlet port, from which concentrated cleansing solution can flow to the overflow pipe connected to the toilet bowl, said distribution valve being positionable by a control device, said distribution valve enabling the selective control of the flow of concentrated cleansing solution to the toilet bowl.

5. The toilet cleaner controller device as recited in claim 4 in which said distribution valve has therein a rotary valving member, said control device being a user operated control knob.

6. The toilet cleaner controller device as recited in claim 5 in which said rotary valving member is positionable in a range of positions between a position permitting concentrated cleansing solution to flow relatively freely from said reservoir to the overflow pipe, and a position entirely shutting off the flow of concentrated cleansing solution to the overflow pipe.

7. The toilet cleaner controller device as recited in claim 5 in which in which said distribution valve also has a second outlet and said rotary valving member is positionable in a range of positions between a position permitting concentrated cleansing solution to flow relatively freely from said reservoir to the overflow pipe, and a position shutting off the flow of concentrated cleansing solution to the overflow pipe, said rotary valving member also being positionable so as to enable the concentrated solution to be delivered simultaneously to the overflow pipe as well as directly to said second outlet.

8. The toilet cleaner controller device as recited in claim 7 in which said second outlet is connected to enable concentrated solution to be delivered directly into the water of the toilet tank.

9. A toilet cleaner controller device for use in a toilet having a tank equipped with a fill device functioning after a flush to refill the tank with water to a selected level, with the toilet tank having an overflow pipe connected to deliver water to the toilet bowl and with the fill device having a water-supplying pipe customarily serving to supply water to the overflow pipe during the refilling of the toilet tank, the improvement comprising a toilet cleaner controller device having therein a pair of compartments, with one of said compartments being a reservoir equipped with a closure member, with said reservoir adapted to receive compressed cleansing tablets designed to slowly dissolve in water, thus to create a concentrated cleansing solution, and the other of said compartments having a distribution valve operably positioned in said controller device, said reservoir being connected to receive water from the water-supplying pipe during the procedure in which the tank is being refilled; so that the concentrated cleansing solution can be maintained in said reservoir, said distribution valve being connected to said reservoir so that the concentrated solution can be delivered to the interior of said distribution valve, said distribution valve having an outlet port from which concentrated cleansing solution can flow to the overflow pipe connected to the toilet bowl, said distribution valve being positionable by a control device, such that the flow of concentrated cleansing solution to the toilet bowl can be selectively controlled.

10. The toilet cleaner controller device as recited in claim 9 in which said distribution valve has therein a rotary valving member, and said control device is a user operated control knob.

11. The toilet cleaner controller device as recited in claim 10 in which said rotary valving member is positionable in a range of positions between a position permitting concentrated cleansing solution to flow relatively freely from said reservoir to the overflow pipe, and a position entirely shutting off the flow of concentrated cleansing solution to the overflow pipe.

12. The toilet cleaner controller device as recited in claim 10 in which said distribution valve has a second outlet, with said second outlet connected to deliver concentrated solution directly into the water of the toilet tank, said rotary valving member being readily positionable by a user so as to direct concentrated cleansing solution to the toilet bowl and to the toilet tank simultaneously.

13. The toilet cleaner controller device as recited in claim 9 in which said distribution valve has a second outlet, and being positionable in a range of positions between a position permitting concentrated cleansing solution to flow relatively freely from said reservoir to the overflow pipe, and a position in which the flow of concentrated cleansing solution to the overflow pipe is shut off, said valve also being positionable so as to enable the concentrated solution to be delivered simultaneously to the overflow pipe and to said second outlet.

14. A toilet cleaner controller device for use in a toilet having a tank equipped with a fill device functioning after a flush to refill the tank with water to a selected level, with the tank having an overflow pipe connected to deliver water to the toilet bowl and also having a water-supplying pipe customarily serving to supply water to the overflow pipe during the refilling of the tank, the improvement comprising a multi-compartmented toilet cleaner controller device, with one of the compartments of said device involving a reservoir adapted to receive compressed cleansing tablets designed to slowly dissolve in water, thereby to create a concentrated cleansing solution therein, said reservoir being connected to receive water from the water-supplying pipe during the procedure in which the tank is being refilled, so that the liquid dispensed from the reservoir will be replenished with fresh water, and the tablets will continue to create a concentrated cleansing solution in the reservoir, another of the compartments of said device containing a distribution valve connected to said reservoir, so that the concentrated cleansing solution can be delivered to the interior of said distribution valve, said distribution valve having an outlet port from which concentrated cleansing solution can flow to the overflow pipe connected to the toilet bowl, said distribution valve having therein a rotary valving member positionable by a control knob, said rotary valving member enabling a user to selectively control the flow of concentrated cleansing solution from said outlet port.

15. The toilet cleaner controller device as recited in claim 14 in which said rotary valving member is positionable in a range of positions between a position permitting concentrated cleansing solution to flow relatively freely from said reservoir to the overflow pipe, and a position entirely shutting off the flow of concentrated cleansing solution to the overflow pipe.

16. The toilet cleaner controller device as recited in claim 14 in which in which said distribution valve has a second outlet, and said rotary valving member is positionable in a range of positions between a position permitting concentrated cleansing solution to flow relatively freely from said reservoir to the overflow pipe, and a position shutting off the flow of concentrated cleansing solution to the overflow pipe, said rotary valving member also being positionable so as to enable the concentrated solution to be delivered simultaneously to the overflow pipe and through said second outlet to the toilet tank.

17. The toilet cleaner controller device as recited in claim 14 in which support means are provided on the exterior of said device, so that it can be readily attached to an upper interior portion of a toilet tank.

18. The toilet cleaner controller device as recited in claim 14 in which lubrication means are provided on said distribution valve so that lubrication can be added to external surfaces of said rotary valving member.

* * * * *